US012680385B2

(12) United States Patent
Niu et al.

(10) Patent No.: US 12,680,385 B2
(45) Date of Patent: Jul. 14, 2026

(54) TORQUE-ADAPTIVE IMPACT TOOL SUITABLE FOR PDC BIT

(71) Applicant: Southwest Petroleum University, Chengdu (CN)

(72) Inventors: Shiwei Niu, Chengdu (CN); Yingxin Yang, Chengdu (CN); Gao Li, Chengdu (CN); Kuilin Huang, Chengdu (CN); Chunliang Zhang, Chengdu (CN); Haitao Ren, Chengdu (CN); Lian Chen, Chengdu (CN)

(73) Assignee: Southwest Petroleum University, Chengdu (CN)

( * ) Notice: Subject to any disclaimer, the term of this patent is extended or adjusted under 35 U.S.C. 154(b) by 394 days.

(21) Appl. No.: 18/358,016

(22) Filed: Jul. 24, 2023

(65) Prior Publication Data

US 2024/0175323 A1 May 30, 2024

(30) Foreign Application Priority Data

Nov. 28, 2022 (CN) ..... 202211498105.5

(51) Int. Cl.
*E21B 4/10* (2006.01)
*E21B 4/00* (2006.01)
*E21B 10/54* (2006.01)

(52) U.S. Cl.
CPC ..... *E21B 4/10* (2013.01); *E21B 4/006* (2013.01); *E21B 10/54* (2013.01)

(58) Field of Classification Search
CPC ..... E21B 4/10; E21B 4/006; E21B 10/54
See application file for complete search history.

(56) References Cited

U.S. PATENT DOCUMENTS 1,845,074 A * 2/1932 Billstrom ..... E21B 4/10 175/298
5,435,402 A * 7/1995 Ziegenfuss ..... E21B 17/076 175/414
10,415,314 B2 * 9/2019 Kartha ..... E21B 6/02

FOREIGN PATENT DOCUMENTS

WO WO-2017056026 A1 * 4/2017 ..... E21B 7/02

* cited by examiner

*Primary Examiner* — Theodore N Yao

(57) ABSTRACT

A torque-adaptive impact tool suitable for a PDC (Polycrystalline Diamond Compact) bit is provided, which includes a PDC bit, a rotary-driving power device, and a torque-adaptive impact tool above the PDC bit. The torque-adaptive impact tool is located between the PDC bit and the rotary-driving power device, includes an outer housing, an upper end cover, a main shaft, an elastic element, an upper impact body, and a lower impact body. In a case of a normal operation of the bit, the tool does not impact the bit, but rotates along with the rotary-driving power device for drilling. In a case that a rock-breaking torque required by the bit exceeds a driving torque, the tool impact the bit.

9 Claims, 9 Drawing Sheets

TORQUE-ADAPTIVE IMPACT TOOL SUITABLE FOR PDC BIT

CROSS-REFERENCE TO RELATED APPLICATION

This patent application claims the benefit and priority of Chinese Patent Application No. 202211498105.5 filed with the China National Intellectual Property Administration on Nov. 28, 2022, the disclosure of which is incorporated by reference herein in its entirety as part of the present application.

TECHNICAL FIELD

The present disclosure belongs to the fields of technical equipment such as petroleum and natural gas drilling engineering, mining engineering, drilling construction of building foundation engineering, geological drilling, geothermal drilling, hydrological drilling, tunnel engineering, shield and trenchless, in particular to a torque-adaptive impact tool suitable for a PDC (Polycrystalline Diamond Compact) bit.

BACKGROUND

Rock breaking is the fundamental problem of drilling. Mechanical rock breaking is still the main operation mode in petroleum and natural gas drilling at present. Bit is a rock breaking tool used for rock breaking and wellbore formation. The bit plays an irreplaceable role in drilling projects as the absolute mainstay; among which, cone bits and PDC bits are most commonly used. The cone bit is used to generate a lateral pressure by means of the extrusion action of teeth on the rock at the bottomhole, the lateral pressure in turn forms a shear force. The rock undergoes fracture failure after reaching the shear strength, and the utilization rate is reduced by the energy transfer and transformation in this process. The PDC bit is gradually replacing the cone bit in soft to medium-hard formations by virtue of its efficient shearing mode for rock breaking. Especially, the rapid progress of cutting tooth material technology, bit basic theory and bit design technology has widened the formation adaptability of the PDC bit, and the proportion of the PDC bit in the total footage of petroleum and gas drilling has increased from 5% in the 1880s to 90%.

Fixed-cutter bits, such as PDC bits, usually have several cutter blades, and there are many cutting teeth on the cutter blades along the radial direction of the bit (for PDC bits, the cutting teeth are mainly made of polycrystalline diamond compact, short for composite sheet or PDC teeth). According to the data, the deep complex formation, which only accounts for 20% of the total footage, costs 80% of the total cost of the whole drilling cycle.

In the drilling process, the cutting teeth of the PDC bit overcome the ground stress to enter the formation under the action of weight on bit and shear and break the formation material under the driving of the torque. Compared with the impact-rolling rock-breaking mode of the cone bit, the required driving torque is larger. When the PDC bit is drilling into the deep and difficult-to-drill formation, especially when drilling into the soft-hard interlaced and gravel formations, the depth of the bit entering the formation changes frequently, and the bit is prone to stick-slip vibration. Stick-slip vibration is characterized by alternating sticking and slippage of the bit. In the sticking stage, the bit stops rotating due to insufficient rock breaking torque, and a drill string is subjected to continuous torsion under the driving of a rotary table. When the accumulated energy of the drill string is enough to break the rock stratum, the stuck bit slips off. In the slippage stage, the energy accumulated by the drill string is released instantly, and the bit suddenly accelerates in the positive direction, the angular velocity of the bit is several times of the rotational speed of the rotary table, and the torque of the bit which is hindered by the rock stratum also fluctuates violently. Stick-slip vibration leads to the reduction of the rate of penetration. After the energy of the drill string is released, the bit oscillates back and forth along the axis of the drill string and is impacted irregularly, resulting in the acceleration of failure.

As a downhole power tool, the screw drilling tool has developed rapidly. Its advantages are that the bottomhole directly provides power to increase the rotational speed and torque of the bit, the accurate orientation, deflection and deviation correction can be achieved, and the screw drilling tool is widely used in drilling constructions such as horizontal wells, window sidetracking, and reaming. General screw, special screw and special purpose screw drilling tools are gradually increasing, and their development prospects are mainly close to long service life, large torque, high rotational speed and multifunction.

Although the rock-breaking efficiency of the bit can be improved by using the screw to drive the bit to rotate at a high speed, when drilling into the nonuniform formation, in a case that the bit undergoes stick-slip when deeply entering the formation, a screw transmission shaft needs to bear an alternating torsional load, which leads to the accelerated failure of the screw drilling tool. In severe cases, the bit is in a sticking state, resulting in pump blocked phenomenon and damage to wellhead surface equipment.

It is an eternal topic in the process of petroleum and natural gas exploration and development to improve the rate of penetration of the PDC bit in complex and difficult-to-drill formations, reduce operation costs and shorten operation cycles. Theoretical research and field practice prove that torsional impact drilling technology is one of the effective ways to improve rock breaking efficiency and rate of penetration of the PDC bit and solve stick-slip vibration of bit. Torsional impact speed-increasing tool can produce periodic torsional impact on the bit while rotating, so as to break the rock.

Most of the torsional impact tools used for the existing PDC bit are driven by liquid, which have the problems of high cost, complex manufacture and poor stability of operation performance. Moreover, the existing impact tools constantly impact on the bit during operating, and the PDC teeth may fail due to the impact load. Therefore, it is necessary to determine whether impact drilling is needed according to different formations and working conditions. For example, when drilling into the formations with uniform lithology or soft rock, the bit should not bear the impact action from upper impact tools. When the bit drills into hard formations or the bit requires a large rock-breaking torque when entering deeper formation, the impact tool plays a role of reducing stick-slip vibration and improve the rate of penetration. Meanwhile, the downhole hydraulic power becomes seriously insufficient as the depth of the well increases, which may lead to the decrease in the impact force of the hydraulic torsional impact tool.

SUMMARY

An objective of the present disclosure is to provide a torque-adaptive impact tool suitable for a PDC bit, which combines an upper rotary-driving power device and determines whether to use the impact tool to provide torsional impact action according to the torque required by the bit, so as to improve the rock-breaking efficiency of the bit while prolonging the service life of PDC teeth.

The objective of the present disclosure is achieved through the following technical solution.

A torque-adaptive impact tool suitable for a PDC (Polycrystalline Diamond Compact) bit, including a PDC bit, a rotary-driving power device, and a torque-adaptive impact tool above the PDC bit, the torque-adaptive impact tool is located between the PDC bit and the rotary-driving power device, and the torque-adaptive impact tool includes an outer housing, an upper end cover, a main shaft, an elastic element, an upper impact body, and a lower impact body.

The main shaft is provided with spiral grooves, and an upper end of the main shaft is connected to a torque output end of the rotary-driving power device.

An upper jaw is arranged on a lower end surface of the upper impact body, and protrusions, in fit with the spiral grooves, are arranged on an inner wall of the upper impact body, and the upper impact body is rotatable along with the main shaft and movable in an axial direction of the main shaft under a combined action of the main shaft, the spiral grooves and the protrusions.

The elastic element is arranged between the upper impact body and the upper end cover.

The upper end cover does not move along an axis of the main shaft, and is configured to support the elastic element.

A lower jaw is arranged on an upper end surface of the lower impact body, and the lower impact body rotates under a driving action of the upper jaw to the lower jaw:

An anti-falling device is arranged between the lower impact body and the outer housing:

In a case of a normal operation, the main shaft rotates under an action of the rotary-driving power device, the upper impact body rotates along with the main shaft due to a pushing action of the spiral grooves to the protrusions, and the lower impact body rotates under the driving action of the upper jaw to the lower jaw so as to drive the PDC bit to rotate, a rotational speed of the PDC bit is same as that of the rotary-driving power device.

In a case that the PDC bit is in a sticking state due to a fact that a rock-breaking torque required by the PDC bit exceeds a torque provided by the upper impact body to the lower impact body, the main shaft remains rotating under the action of the rotary-driving power device, the upper impact body moves upward under the pushing action of the spiral grooves to the protrusions to compress the elastic element: when the upper jaw passes over the lower jaw, the upper impact body moves downwards under an action of the elastic element and is accelerated to rotate under the pushing action of the spiral grooves so as to enable the upper jaw to generate rotary impact on the lower jaw:

In above solution, the main shaft can be driven to rotate by means of the high-speed rotation of the rotary-driving power device. By virtue of the fitting of the spiral grooves on the main shaft and the protrusions of the upper impact body, as the spiral groove is an inclined plane, the inclined plane can push the upper impact body to rotate. By virtue of the meshing transmission between the upper jaw of the upper impact body and the lower jaw of the lower impact body, the lower impact body is driven by the upper impact body to rotate. Then the PDC bit is driven to rotate for rock breaking, which is the same as the conventional drilling operation mode. However, once the torque required by the lower bit for rock breaking exceeds the torque during normal operation, or the bit is stuck due to excessive depth of entering the formation, that is, a circumferential driving force of the spiral groove on the protrusion is not enough to make the drill bit rotate normally for rock breaking, and the spiral groove generates a lifting force on the protrusion in an axial direction, so as to lift the upper impact body upwards in the axial direction. Meanwhile, the upper impact body compresses the elastic element. When the lifting height of the upper impact body exceeds a meshing height of the upper jaw and the lower jaw: the upper jaw passes over the lower jaw and rotates at an accelerated speed under the circumferential pushing action of the spiral groove on the protrusion. The compressed elastic element releases energy to push the upper impact body to move downwards. The upper jaw rotating at an accelerated speed generates one impact on the lower impact body when making contact with the lower impact body again, the bit can overcome the reaction torque of the formation and continue to rotate under the rotary impact. After breaking through the reaction torque of the formation, the bit rotates normally, and the upper impact body no longer impacts the lower impact body. The above-mentioned process can be simplified as: the bit rotates normally-if the torque is excessive-rotary impact is generated on the bit-the bit operates normally . . . , and the above-mentioned process is repeatedly cycled. In accordance with such an operating mode, the impact vibration damage and fatigue failure of cutting teeth caused by the continuous impact of conventional impact rock breaking mode are avoided, whether to impact the bit is determined according to the actual operating conditions of the bit by combining the torque provided by the upper rotary-driving power device, which can improve the energy utilization rate, prolong the service life of the bit and ensure the operating efficiency of the bit.

In some embodiments, the rotary-driving power device is a turbine drilling tool, a screw drilling tool, or an electric drilling tool.

In above solution, the rotary-driving power device can be selected according to the actual drilling needs, for example, the screw drilling tool can be used for drilling a directional well and a cluster well, the turbine drilling tool can be used for the operations requires high speed, large torque, small vibration, deep well and high temperature environment, and the electric drilling tool can be used for a horizontal well and a highly deviated extended well.

In some embodiments, a height of a contact area between the upper jaw and the lower jaw is smaller than that of the upper jaw and the lower jaw:

In the above solution, the height of the contact area between the upper jaw and the lower jaw is smaller than that of the upper jaw and the lower claw: such that the energy released by the compressed elastic element does not impact the lower impact body when pushing the upper impact body downwards, and the situation that the bit cannot work as the bit enters the deeper formation caused by the upper impact body impacting the lower impact body is avoided.

In some embodiments, a number of the spiral grooves on the main shaft is at least two, and a number of the protrusions on the inner wall of the upper impact body is same as that of the spiral grooves.

In the above solution, multiple spiral grooves are in fit with multiple corresponding protrusions respectively, which make the acting load of the main shaft on the upper impact body more balanced, and improve the stability and reliability of operation. A smaller number of spiral grooves and protrusions can be provided to increase the rotary impact force, or more spiral grooves and protrusions can be arranged to improve the stability of torque transmission between the upper impact body and the lower impact body.

In some embodiments, the elastic element may be a leaf spring, a coil spring, a disc spring, a gas spring, or a rubber spring.

In the above solution, different elastic elements can be selected according to the requirements for the reaction speed to the downward movement of the upper impact body. Certainly, a combination of at least two of different elastic elements above can be used.

In some embodiments, the protrusions on the inner wall of the upper impact body are in a spherical shape, or the protrusions on the inner wall of the upper impact body are in a spiral shape in fit with the spiral grooves on the main shaft respectively.

In the above solution, the shape of the protrusion may be flexibly set according to the size of the upper impact body, and the protrusion may be an independent spherical protrusion when the size of the upper impact body is small or a compression coefficient of the elastic element is small, which is easy to manufacture. When the elastic element with a large elastic coefficient is provided for the upper impact body to restore rapidly to the original position to mesh with the lower impact body, or when a large torque is required for driving, the protrusion may be a spiral protrusion in fit with the spiral groove.

In some embodiments, the protrusions are each provided with a rotatable component.

In the above solution, the protrusion is provided with the rotatable component, for example, a roller or a ball is arranged on the protrusion, the friction between the protrusion and the spiral groove can be reduced, and thus the service life can be prolonged.

In some embodiments, the upper end cover is fixed to the main shaft, or is fixed to the outer housing.

In above solution, the upper end cover is fixed to the main shaft, and can be processed and formed together with the main shaft to reduce the manufacturing difficulty. If the upper end cover is arranged on the outer housing, the upper end cover does not rotate along with the main shaft, the elastic element is free of torsion, and the sensitivity and service life of the elastic element are improved.

In some embodiments, additional auxiliary-cutting structures are provided on the PDC bit.

In the above solution, additional auxiliary-cutting structures may a be cone rock-breaking structure, a disc cutter rock-breaking structure, an impact rock-breaking structure, or a combination of at least two of the rock-breaking structures above. According to different formation conditions and drilling technology parameters, different cutting structure combinations are selected to enhance the adaptability of the bit in a specific formation.

Compared with the prior art, the present disclosure has the following beneficial effects.

First, when drilling normally, a rotary-driving power device (such as a screw) at the upper part of the bit rotates at a high speed, and the torque-adaptive impact tool only drives the bit to break rock efficiently at the same rotational speed as that of a driving source, such that the torque-adaptive impact tool does not generate impact on the bit, the rapid damage to the PDC teeth due to impact vibration is reduced, and the service life of the bit is prolonged.

Second, when the bit is stuck due to excessive depth of entering the formation, or the rock-breaking torque required by the bit exceeds a rated torque provided by the upper rotary-driving source, the torque-adaptive impact tool may generate torsion and impact on the bit without affecting the normal operation of the upper rotary-driving power device, so as to ensure that the upper rotary-driving power device is in a safe and stable operation state. The purposes of improving the rock-breaking efficiency, eliminating the stick-slip vibration of the bit and protecting the rotary-driving power device and a ground pressure pump are achieved.

BRIEF DESCRIPTION OF THE DRAWINGS

The present disclosure is described by way of specific embodiments with reference to the accompanying drawings.

Figure 1:
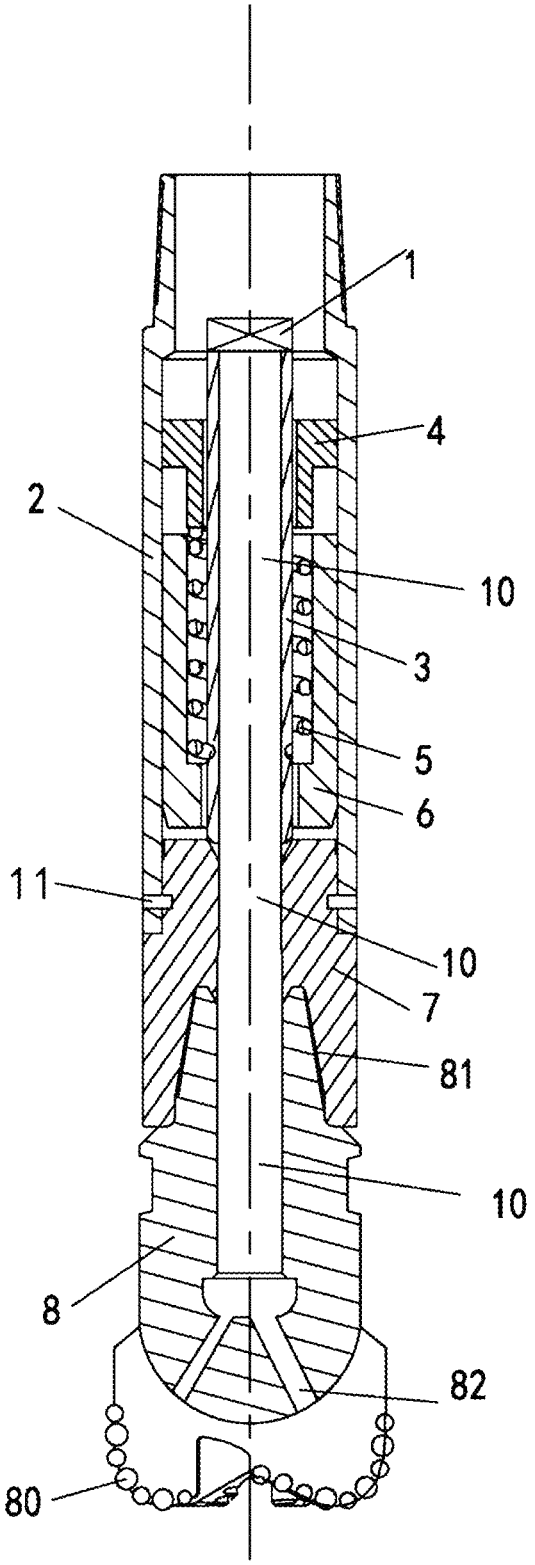
FIG. 1 is a structural schematic diagram of a torque-adaptive impact tool suitable for a PDC bit in accordance with embodiments of the present disclosure.

Reference numbers: 1 rotary-driving power device; 2 outer housing; 20 outer housing thread; 21 pin hole; 3 main shaft; 30 spiral groove; 4 upper end cover; 40 larger step bottom surface; 41 smaller cylindrical step; 5 elastic element; 6 upper impact body; 60 upper jaw; 61 protrusion; 7 lower impact body; 70 lower jaw; 71 annular groove; 8 PDC bit; 80 PDC tooth; 81 bit joint; 82 nozzle; 83 cone rock-breaking structure; 84 disc cutter rock-breaking structure; 9 rock; 10 flow channel; 11 anti-falling device.

DETAILED DESCRIPTION OF THE EMBODIMENTS

In order to make the objectives, technical solutions and advantages of the embodiments of the present disclosure more clearly, the following clearly and completely describes the technical solutions in the embodiments of the present disclosure with reference to the accompanying drawings in the embodiments of the present disclosure. Apparently, the described embodiments are merely a part rather than all of the embodiments of the present disclosure. The components of embodiments of the present disclosure generally described and illustrated in the drawings herein may be arranged and designed in a variety of different configurations.

Accordingly, the following detailed description of the embodiments of the present disclosure provided in the accompanying drawings is not intended to limit the claimed protection scope of the present disclosure, but is merely representative of selected embodiments of the present disclosure. All other embodiments obtained by a person of ordinary skill in the art based on the embodiments of the present disclosure without creative efforts shall fall within the protection scope of the present disclosure.

It should be noted that the embodiments in the present disclosure and the features in the embodiments can be combined with each other without conflict.

It should be noted that like numerals and letters denote like items in the following drawings, and therefore, once an item is defined in one drawing, it does not need to be further defined and explained in subsequent drawings.

In the description of the present disclosure, the indicated orientation or positional relationship is based on the orientation or positional relationship shown in the drawings, or the orientation or position relationship that the product of the present disclosure is usually placed in use, or the orientation or position relationship that is commonly understood by those skilled in the art, or the orientation or position relationship that the product of the present disclosure is usually placed in use, only for convenience of description of the present disclosure and simplification of description rather than indicating or implying that the device or element referred to must have a particular orientation, be constructed and operate in a particular orientation, and thus are not to be construed as limiting the present disclosure.

In the present disclosure, unless expressly specified and limited otherwise, it also should be noted that the terms "provide" and "connect" should be understood broadly, e.g., may be either a fixed connection or a detachable connection, or a connection in one piece: may be a direct connection or an indirect connection through an intermediate medium. For those of ordinary skill in the art, the specific meanings of the terms above in the present disclosure may be understood in specific situations. The following clearly and completely describes the technical solutions in the embodiments of the present disclosure with reference to the accompanying drawings in the embodiments of the present disclosure. Apparently, the described embodiments are merely a part rather than all of the embodiments of the present disclosure. The components of embodiments of the present disclosure generally described and illustrated in the drawings herein may be arranged and designed in a variety of different configurations.

A torque-adaptive impact tool suitable for a PDC bit is provided, which includes a PDC bit 8, a rotary-driving power device 1, and a torque-adaptive impact tool above the PDC bit 8. The torque-adaptive impact tool is located between the PDC bit 8 and the rotary-driving power device 1, and includes an outer housing 2, an upper end cover 4, a main shaft 3, an elastic element 5, an upper impact body 6, and a lower impact body 7.

The main shaft 3 is provided with spiral grooves 30, and an upper end of the main shaft 3 is connected to a torque output end of the rotary-driving power device 1.

An upper jaw 60 is arranged on a lower end surface of the upper impact body 6. Protrusions 61, in fit with the spiral grooves 30, are arranged on an inner wall of the upper impact body 6, and the upper impact body 6 can rotate along with the main shaft 3, and move in an axial direction of the main shaft 3 under the combined action of the main shaft 3, the spiral grooves 30 and the protrusions 61.

The elastic element 5 is arranged between the upper impact body 6 and the upper end cover 4.

The upper end cover 4 does not move along the axis of the main shaft 3, and is configured to support the elastic element 5.

A lower jaw 70 is arranged on an upper end surface of the lower impact body 7, and the lower impact body 7 rotates under the driving action of the upper jaw 60 to the lower jaw 70.

The anti-falling device 11 is arranged between the lower impact body 7 and the outer housing 2.

In a case of a normal operation, the main shaft 3 rotates under the action of the rotary-driving power device 1. The upper impact body 6 rotates along with the main shaft 3 due to the pushing action of the spiral grooves 30 to the protrusions 61, and the lower impact body 7 rotates under the driving action of the upper jaw 60 to the lower jaw 70, thereby driving the PDC bit 8 to rotate. A rotational speed of the PDC bit 8 is the same as that of the rotary-driving power device 1.

In a case that the PDC bit 8 is in a sticking state due to the fact that the PDC bit 8 enters deeper into the formation and a rock-breaking torque required by the PDC bit 8 exceeds a torque provided by the upper impact body 6 to the lower impact body 7, the main shaft 3 remains rotating under the action of the rotary-driving power device 1. The upper impact body 6 moves upwards under the pushing action of the spiral grooves 30 to the protrusions 61 to compress the elastic element 5. When the upper jaw 60 passes over the lower jaw 70, the upper impact body 6 moves downwards under the action of the elastic element 5 and is accelerated to rotate under the pushing action of the spiral grooves 30, thereby enabling the upper jaw 60 to generate rotary impact on the lower jaw 70.

As shown in FIG. 1, a structural schematic diagram of a bit in accordance with an embodiment of the present disclosure is provided. Specifically, the main shaft 3 is connected to a torque or rotational speed output end of the rotary-driving power device 1 above, and one end, approximate the lower impact body, of the main shaft 3 is provided with the spiral grooves 30. An upper end cover 4 is provided between an outer wall of the main shaft 3 and an inner wall of the outer housing 2, and plays a role in axially restraining the elastic element 5 installed below. The upper end cover 4 can be machined separately and then fixed to the inner wall of the outer housing 2 or the main shaft 3 by welding or pinning, or can be machined integrally with the outer housing 2 or with the main shaft 3. The upper impact body 6 is below the upper end cover 4, the upper impact body 6 may move up and down along the axis of the main shaft 3, and may also rotate around the axis of the main shaft 3. Since the protrusion 61 provided on the upper impact body 6 may slide with respect to the spiral groove 30, as the main shaft 3 rotates, the spiral groove 30 may generate a thrust force in a circumferential direction and a lifting force in an axial direction on the protrusion 61, thereby achieving the rotation and lifting movement of the upper impact body 6. The elastic element 5 is installed in an inner hole of the upper impact body 6, and the upper end cover 4 can restrain one end of the elastic element 5, while an inner hole seat of the upper impact body 6 can restrain the other end of the elastic element 5. When the upper impact body 6 is lifted upwards, the elastic element 5 is compressed, and when the lifting force decreases or disappears, the position recovery of the upper impact body 6 depends on the compressed elastic element 5. The lower impact body 7 is installed below the upper impact body 6. A torque and rotational speed are transmitted between the upper impact body 6 and the lower impact body 7 through the upper jaw 60 arranged on the upper impact body 6 and the lower jaw 70 arranged on the lower impact body 7. An anti-falling device 11 is arranged between the lower impact body 7 and the outer housing 2. The lower impact body 7 can freely rotate with respect to the outer housing 2, and weight on bit is transferred by the outer housing 2 to the lower impact body 7. The lower impact body 7 is threaded to the PDC bit 8 below through the bit joint 81 to form a fixed connection, and the PDC bit 8 can be driven to rotate by the rotation of the lower impact body 7, thereby causing PDC teeth 80 to break the rock by scraping. It should be noted that in order to make drilling fluid circulate smoothly, the center of the main shaft 3, the lower impact body 7 and the PDC bit 8 are each provided with a flow channel 10, which communicates in sequence, and finally the drilling fluid can flow out from a nozzle 82 of the PDC bit 8.

The rotary-driving power device 1 may be a turbine drilling tool, a screw drilling tool, or an electric drilling tool.

The elastic element 5 may be a leaf spring, a coil spring, a disc spring, a gas spring, or a rubber spring, in which the coil spring is preferably.

Figure 2:
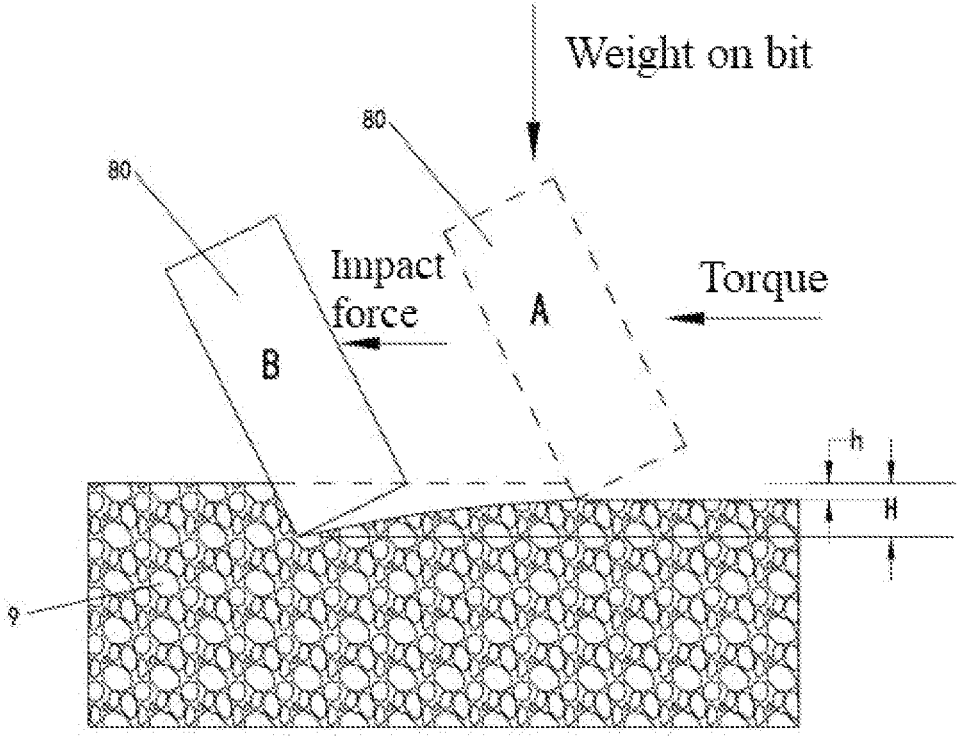
FIG. 2 is a schematic diagram of a rock-breaking process that PDC teeth on the PDC bit scraps a rock in accordance with embodiments of the present disclosure.

FIG. 2 is a schematic diagram of a rock-breaking process that PDC teeth on the PDC bit scrap a rock. The PDC teeth 80 enter the rock 9 under the action of the weight on bit, and scrape the rock 9 under the action of torque provided by the rotary-driving power device 1. Under a certain torque and weight on bit, the PDC teeth 80 break the rock 9 in a state of entering the rock 9 at a depth of h (when the PDC teeth 80 are in position A in FIG. 2), and at this time, the PDC bit 8 is in a normal and stable operating state. However, due to the unstable fluctuation of weight on bit application or when drilling into the heterogeneous rock 9, when the weight on bit is increased or the drilled formation rock 9 is soft, the depth of entering of the PDC teeth 80 may be gradually increased to H (the PDC teeth 80 are in position B in FIG. 2). Due to the increase of depth of entering, the torque required by the PDC teeth 80 to scrape and break the rock 9 is increased accordingly. Before the torque provided by the rotary-driving power device 1 reaches this torque, the PDC bit 8 may stop rotating. At this time, the energy is accumulated as the rotary-driving power device 1 above continues to rotate, and when the accumulated energy is enough to overcome the formation resistance, the PDC bit 8 suddenly rotates at a speed which is several times of the normal speed. At this time, the PDC bit 8 is in a slippage state, and such a process is the cause of stick-slip vibration of the PDC bit 8. On the one hand, the stick-slip vibration can make the PDC teeth 80 bear large impact load, resulting in rapid impact failure of the PDC teeth 80. On the other hand, the rotary-driving power device 1 continues to twist the upper drilling tool to cause the large torsional deformation of the upper drilling tool, resulting in the failure of the upper drilling tool due to fatigue, and in severe cases, the upper drilling tool may be twisted off, resulting in serious downhole accidents.

Figures 3A, 3B, 3C:
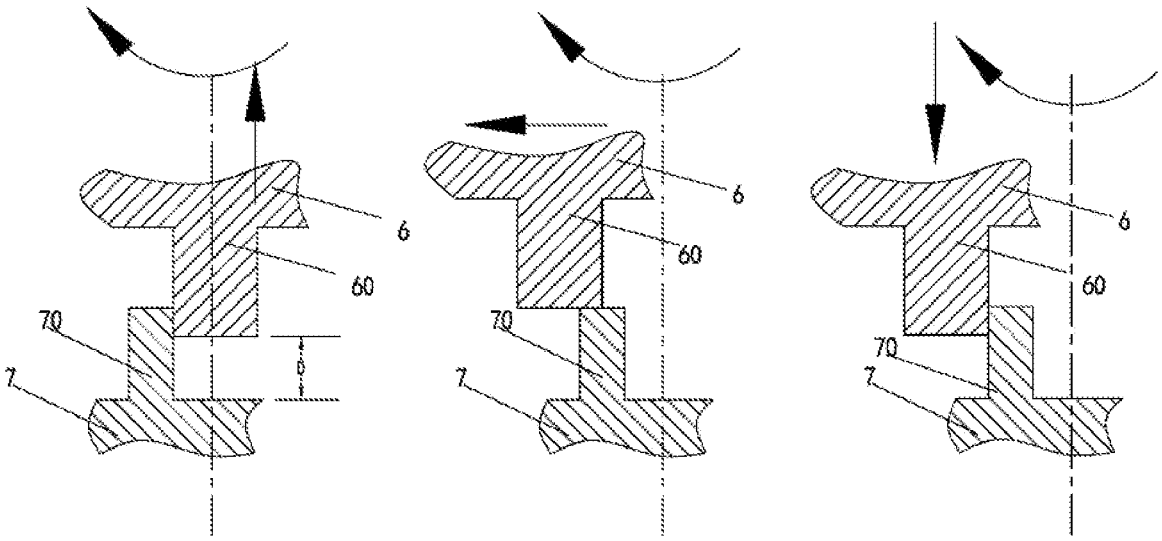
FIGS. 3A to 3C are schematic diagrams of an operating state when an upper impact body is in contact with a lower impact body in accordance with embodiments of the present disclosure.

FIGS. 3A to 3C are schematic diagrams of a working state when an upper impact body 6 is in contact with a lower impact body 7, which illustrates the operating principle of the present disclosure to solve the stick-slip vibration of the PDC bit 8 and improve the rock breaking efficiency of the PDC bit 8 by using torsional impact. In a normal operating state, the torque and rotational speed is transmitted by the upper impact body 6 to the lower impact body 7 through the thrust force of the upper jaw 60 to the lower jaw 70. When the lower impact body 7 stops rotating, the upper impact body 6 also stops rotating under the blocking action of the lower jaw 70 of the lower impact body 7, while the main shaft 3 still rotates. Under the action of the lifting force (lifting force of the spiral groove 30 to the protrusion 61), the upper impact body 6 can compress the elastic element while moving upwards (climbing upwards along the lower jaw 70) until the upper impact body reaches a top end of lower jaw 70. At this time, the resistance of lower jaw 70 to a rotation direction of the upper impact body 6 is eliminated, and the upper impact body 6 is accelerated to rotate under the action of an external thrust. When the upper jaw 60 of the upper impact body 6 completely passes over the lower jaw 70, the supporting force of the lower jaw 70 to the upper impact body 6 is also eliminated, and under the action of a restoring force of the elastic element. When making contact with the lower jaw 70 again, the upper impact body 6 rotating in an accelerated speed may generate an impact force in the torsional direction on the lower jaw 70 (when the PDC teeth 80 are in position B in FIG. 2), so as to release the sticking state of the PDC bit 8 and make the PDC bit 8 in a normal operating state. However, once the resistance of the PDC bit 8 is within the normal operating range, the operating process of torsional impact will not occur. The adaptation of the impact tool to the torque of the PDC bit 8 is achieved through the above operating principle processes, and the magnitude of torque transmission is adjusted through the change of structural parameters, so as to improve the rock-breaking efficiency of the PDC bit 8 by using the impact action.

Figure 4:
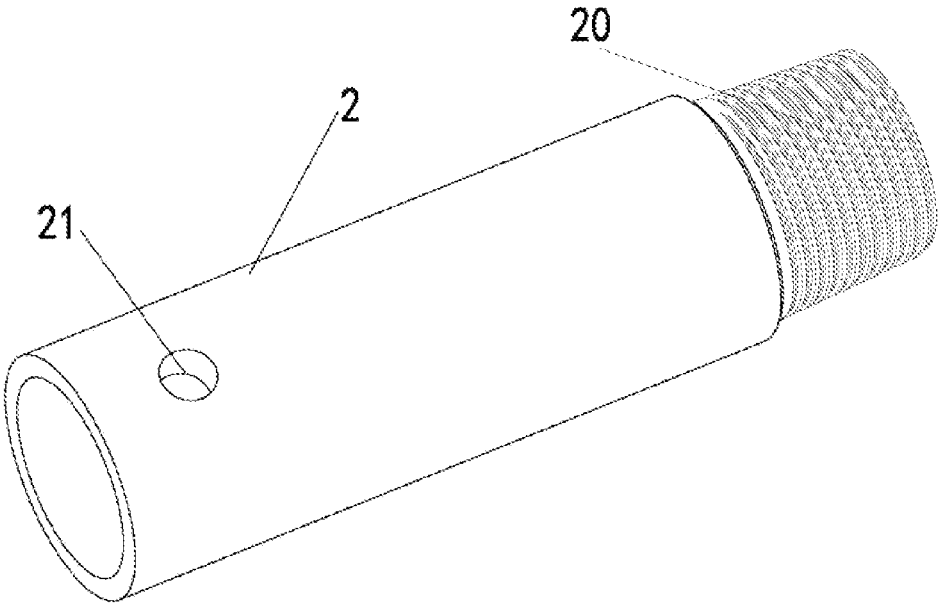
FIG. 4 is a schematic diagram of an outer housing in accordance with embodiments of the present disclosure.

FIG. 4 is a schematic diagram of an outer housing 2. One end of the outer housing is provided with an outer housing thread 20 to connect an outer housing of the upper drilling tool. The outer housing 2 is also provided with a pin hole 21 for inserting a pin to connect the lower impact body 7, so as to prevent the lower impact body 7 from falling. Certainly, the fall prevention between the outer housing 2 and the lower impact body 7 may also be carried out by means of balls.

Figure 5:
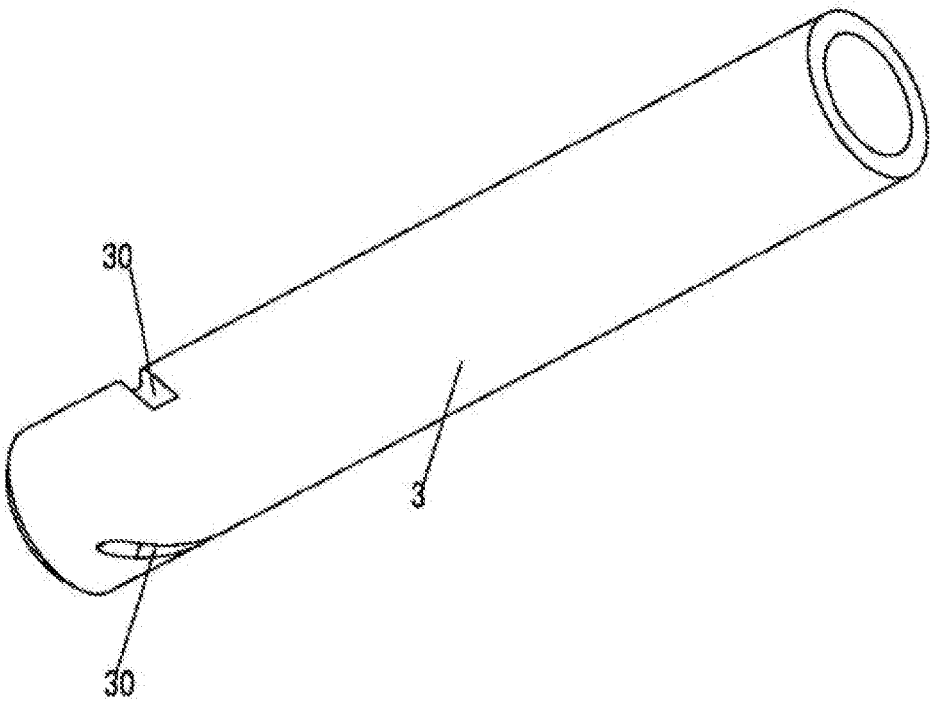
FIG. 5 is a structure schematic diagram of a main shaft in accordance with embodiments of the present disclosure.

FIG. 5 is a structural schematic diagram of a main shaft 3. The main shaft 3 is provided with at least one spiral groove 30. The multiple spiral grooves 30 may be independent of each other, or may be spiral grooves 30 communicating with each other in the circumferential direction.

Figure 6:
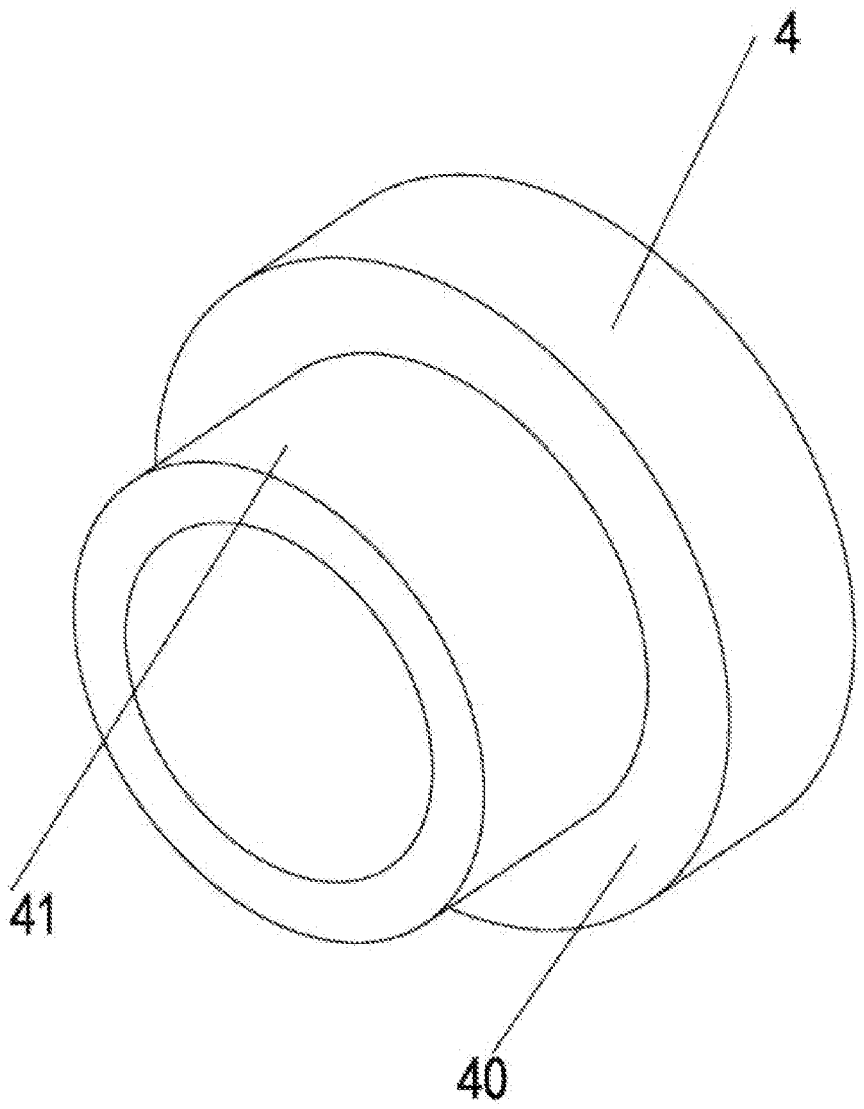
FIG. 6 is a structure schematic diagram of an upper end cover in accordance with embodiments of the present disclosure.

FIG. 6 is a structural schematic diagram of an upper end cover 4. The upper end cover 4 mainly plays a role of restraining the elastic element 5. In this embodiment, the upper end cover 4 is provided as a cylindrical step shape, the larger step bottom surface 40 of is in contact with the end surface of the elastic element 5, and a smaller cylindrical step 41 is used to play an axial guiding and straightening role when the upper impact body 6 moves upward, thus making the upper impact body 6 more smoothly when moving upwards.

Figure 7:
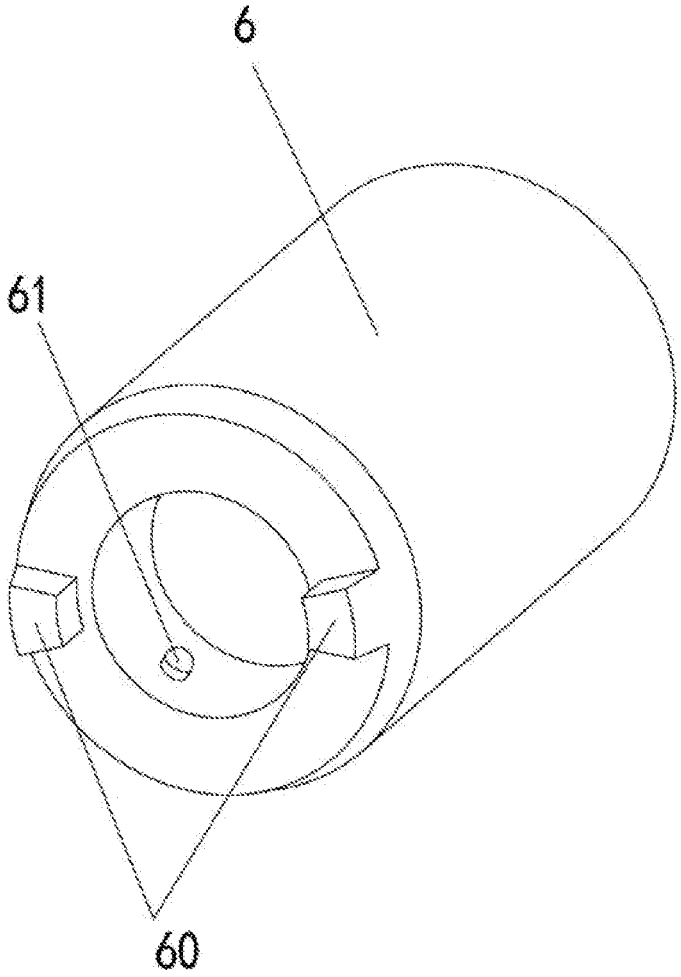
FIG. 7 is a general view of an upper impact body in accordance with embodiments of the present disclosure.
Figure 8A:
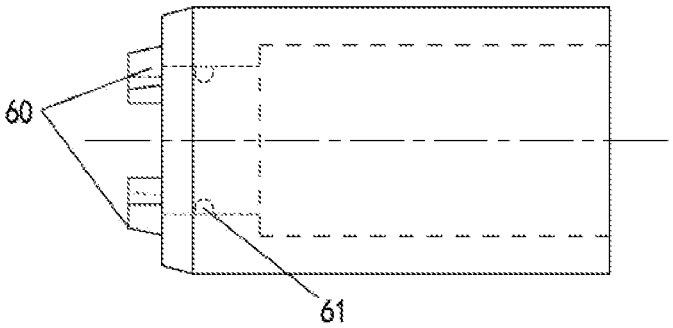
FIG. 8A is a front view of the upper impact body and FIG. 8B is a left view of the upper impact body in accordance with embodiments of the present disclosure.
Figure 8B:
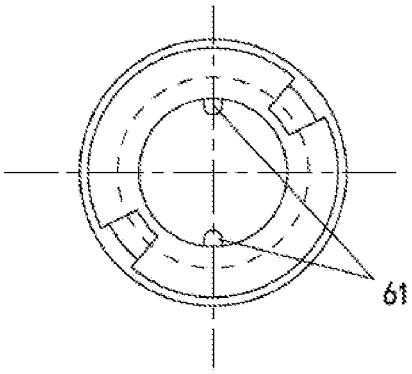
Figure 9:
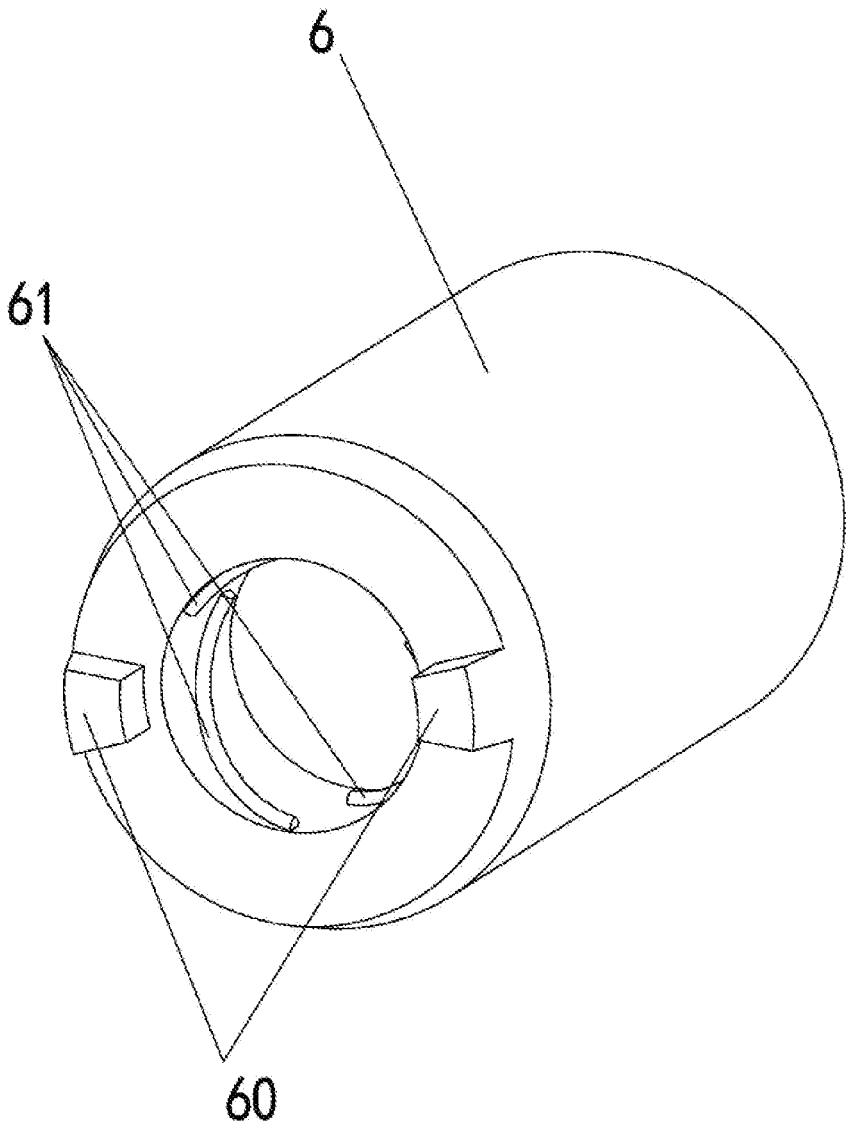
FIG. 9 is a schematic diagram of another structure form of the upper impact body in accordance with embodiments of the present disclosure.

FIGS. 7, 8A and 8B are structural schematic diagrams of an upper impact body 6. At least one upper jaw 60 is arranged at a lower end of the upper impact body 6, and multiple upper jaws 60 are uniformly distributed in the circumferential direction. At least one protrusion 61 is provided inside the upper impact body 6, and multiple protrusions 61 are uniformly distributed in the circumferential direction. The elastic element 5 is located on the step surface of the inner hole of the upper impact body 6. The protrusion 61 on the upper impact body 6 may be a spherical protrusion 61, or a spiral protrusion 61 meshing with the spiral groove 30 on the main shaft 3, as shown in FIG. 9, so as to achieve greater torque transmission.

Figure 10:
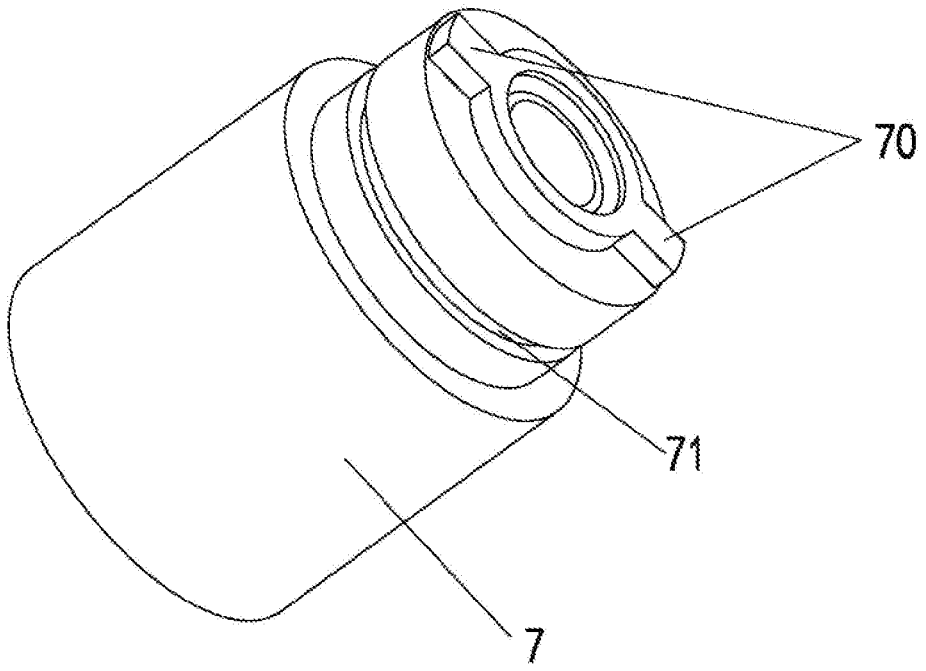
FIG. 10 is a structure schematic diagram of a lower impact body in accordance with embodiments of the present disclosure.

FIG. 10 is a structural schematic diagram of a lower impact body 7. At least one lower jaw 70 is arranged at one end of the lower impact body 7 in the circumferential direction, and the other end of the lower impact body 7 is fixedly connected to the PDC bit 8. The lower impact body 7 is also provided with an annular groove 71 for connecting the main shaft 3, for example by inserting a pin or by inserting a ball. Certainly, the connection between the lower impact body 7 and the outer housing 2 can be achieved in other ways as long as the lower impact body 7 can be prevented from falling off the outer housing 2.

Figure 11:
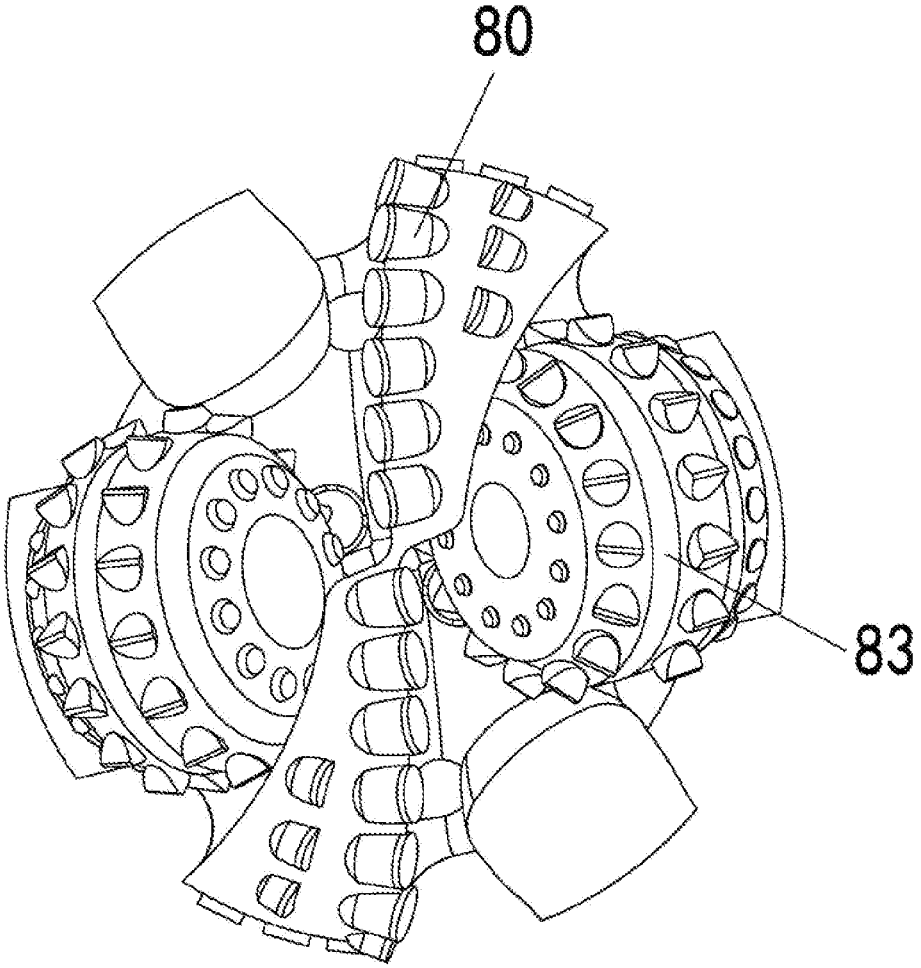
FIG. 11 shows a PDC-cone combination bit with a cone cutting structure in accordance with embodiments of the present disclosure.
Figure 12:
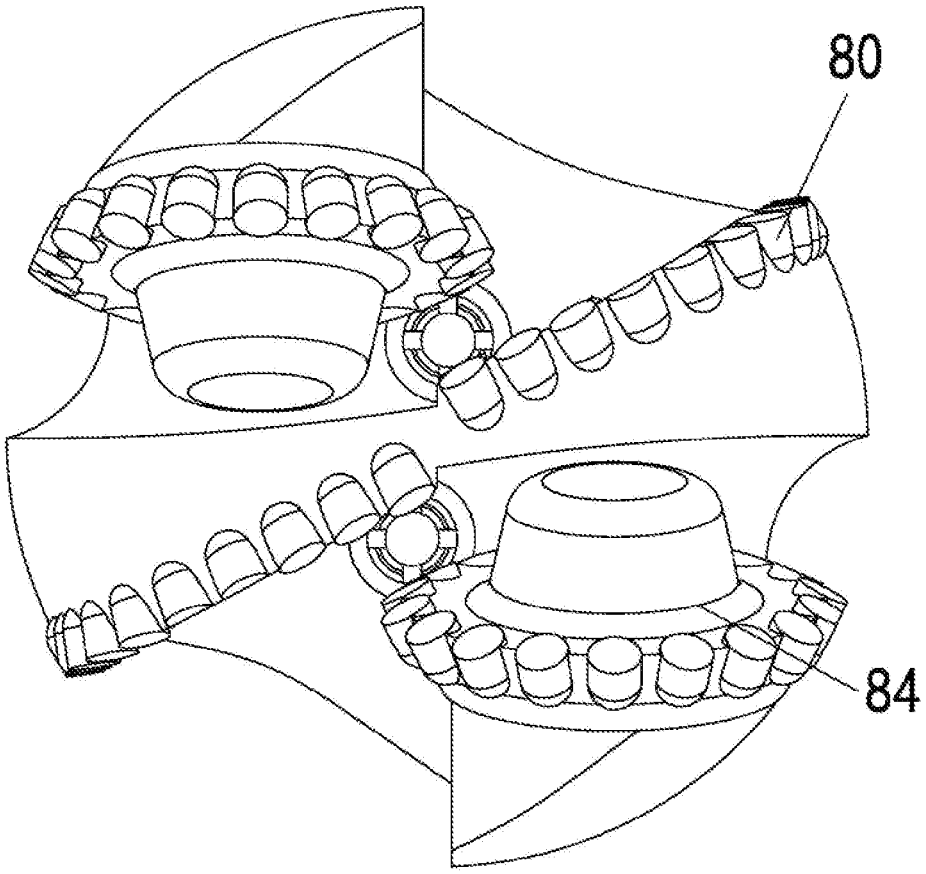
FIG. 12 shows a cross-scraping PDC bit with a disc cutter rock-breaking structure.

The PDC bit 8 may be a PDC bit with additional auxiliary-cutting structures, such as a PDC-cone combination bit with a cone rock-breaking structure 83 on the PDC bit (as shown in FIG. 11), a cross-scraping PDC bit with a disc cutter rock-breaking structure 84 (as shown in FIG. 12), and the like. According to different formation conditions and drilling technology parameters, different cutting structure combinations are selected to enhance the adaptability of bit in specific formation.

The embodiments of the present disclosure described above and shown in the drawings do not limit the scope of the present disclosure, but rather cover the scope of the present disclosure by the scope of appended claims and their legal equivalents. Any equivalent embodiment is within the scope of the present disclosure. Indeed, based on the foregoing description, various improvements of the present disclosure are apparent to those skilled in the art, except for those, such as alternative useful combinations of the elements described, shown and described herein. Such improvements and implementations are within the scope of the appended claims and equivalents.

What is claimed is:

1. A torque-adaptive impact system, comprising a Polycrystalline Diamond Compact (PDC) bit, a rotary-driving power device, and a torque-adaptive impact tool above the PDC bit, wherein the torque-adaptive impact tool is located between the PDC bit and the rotary-driving power device, and the torque-adaptive impact tool comprises an outer housing, an upper end cover, a main shaft, an elastic element, an upper impact body, and a lower impact body;

the main shaft is provided with spiral grooves, and an upper end of the main shaft is connected to a torque output end of the rotary-driving power device;

an upper jaw is arranged on a lower end surface of the upper impact body, and protrusions, in fit with the spiral grooves, are arranged on an inner wall of the upper impact body, and the upper impact body is rotatable along with the main shaft and movable in an axial direction of the main shaft under a combined action of the main shaft, the spiral grooves and the protrusions;

the elastic element is arranged between the upper impact body and the upper end cover;

the upper end cover does not move along an axis of the main shaft, and is configured to support the elastic element;

a lower jaw is arranged on an upper end surface of the lower impact body, and the lower impact body rotates under a driving action of the upper jaw to the lower jaw;

an anti-falling device is arranged between the lower impact body and the outer housing;

in a case of a normal operation, the main shaft rotates under an action of the rotary-driving power device, the upper impact body rotates along with the main shaft due to a pushing action of the spiral grooves to the protrusions, and the lower impact body rotates under the driving action of the upper jaw to the lower jaw so as to drive the PDC bit to rotate, wherein a rotational speed of the PDC bit is same as that of the rotary-driving power device; and in a case that the PDC bit is in a sticking state due to a fact that a rock-breaking torque required by the PDC bit exceeds a torque provided by the upper impact body to the lower impact body, the main shaft remains rotating under the action of the rotary-driving power device, the upper impact body moves upward under the pushing action of the spiral grooves to the protrusions to compress the elastic element; when the upper jaw passes over the lower jaw; the upper impact body moves downwards under an action of the elastic element and is accelerated to rotate under the pushing action of the spiral grooves so as to enable the upper jaw to generate rotary impact on the lower jaw.

2. The torque-adaptive impact system according to claim 1, wherein the rotary-driving power device is a turbine drilling tool, a screw drilling tool, or an electric drilling tool.

3. The torque-adaptive impact system according to claim 1, wherein a height of a contact area between the upper jaw and the lower jaw is smaller than that of the upper jaw and the lower jaw.

4. The torque-adaptive impact system according to claim 1, wherein a number of the spiral grooves on the main shaft is at least two, and a number of the protrusions on the inner wall of the upper impact body is same as that of the spiral grooves.

5. The torque-adaptive impact system according to claim 1, wherein the elastic element is a leaf spring, a disc spring, a coil spring, a gas spring, or a rubber spring.

6. The torque-adaptive impact system according to claim 1, wherein the protrusions on the inner wall of the upper impact body are in a spherical shape, or the protrusions on the inner wall of the upper impact body are in a spiral shape in fit with the spiral grooves on the main shaft respectively.

7. The torque-adaptive impact system according to claim 1, wherein the protrusions are each provided with a rotatable component.

8. The torque-adaptive impact system according to claim 1, wherein the upper end cover is fixed to the main shaft, or is fixed to the outer housing.

9. The torque-adaptive impact system according to claim 1, wherein additional auxiliary-cutting structures are provided on the PDC bit.

* * * * *